US009206716B2

(12) United States Patent
Nowak et al.

(10) Patent No.: US 9,206,716 B2
(45) Date of Patent: Dec. 8, 2015

(54) MECHANICALLY CONTROLLABLE VALVE DRIVE ARRANGEMENT

(71) Applicant: KOLBENSCHMIDT PIERBURG INNOVATIONS GMBH, Neckarsulm (DE)

(72) Inventors: Martin Nowak, Leverkusen (DE); Karsten Grimm, Aachen (DE); Michael Breuer, Simmerath (DE)

(73) Assignee: KOLBENSCHMIDT PIERBURG INNOVATIONS GMBH, Neckarsulm (DE)

( * ) Notice: Subject to any disclaimer, the term of this patent is extended or adjusted under 35 U.S.C. 154(b) by 0 days.

(21) Appl. No.: 14/383,109

(22) PCT Filed: Dec. 17, 2012

(86) PCT No.: PCT/EP2012/075788
§ 371 (c)(1),
(2) Date: Sep. 5, 2014

(87) PCT Pub. No.: WO2013/131593
PCT Pub. Date: Sep. 12, 2013

(65) Prior Publication Data

US 2015/0027392 A1 Jan. 29, 2015

(30) Foreign Application Priority Data

Mar. 8, 2012 (DE) ..... 10 2012 004 413

(51) Int. Cl.
*F01L 1/34* (2006.01)
*F01L 13/00* (2006.01)

(52) U.S. Cl.
CPC ..... *F01L 13/0063* (2013.01); *F01L 13/0021* (2013.01); *F01L 13/0026* (2013.01); *F01L 2013/0068* (2013.01); *F01L 2105/00* (2013.01)

(58) Field of Classification Search
CPC ..... F01L 13/0021; F01L 13/0063; F01L 2105/00
USPC ..... 123/90.39, 90.44, 90.16
See application file for complete search history.

(56) References Cited

U.S. PATENT DOCUMENTS 6,886,512 B2 * 5/2005 Naumann ..... 123/90.39
7,367,298 B2 5/2008 Meyer et al.

(Continued)

FOREIGN PATENT DOCUMENTS

| | | | |
|---|---|---|---|
| DE | 101 36 612 | A1 | 2/2003 |
| DE | 10 2005 041 299 | A1 | 3/2006 |
| DE | 10 2006 033 559 | A1 | 1/2008 |
| DE | 10 2006 047 539 | A1 | 4/2008 |
| DE | 10 2007 022 266 | A1 | 11/2008 |
| JP | 2004-522065 | A | 7/2004 |
| JP | 2005-54700 | A | 3/2005 |

(Continued)

*Primary Examiner* — Ching Chang
(74) *Attorney, Agent, or Firm* — Norman B. Thot

(57) ABSTRACT

A mechanically controllable valve drive arrangement includes gas exchange valves each having cylinders associated therewith, a camshaft comprising a peripheral contour, a bearing, an adjusting lever comprising a first end and a second end, a valve lift adjustment device comprising a control shaft which acts on the first end, and a transmission arrangement associated with a respective gas exchange valve. The adjusting lever is supported in the bearing. Each transmission arrangement comprises at least one intermediate lever arrangement comprising an engagement element, and an intermediate lever comprising a working cam, and at least one pivot lever arrangement comprising a pivot lever. The working cam is operatively connected to the pivot lever. The intermediate lever is operatively connected to the peripheral contour. The engagement element is operatively connected to the valve lift adjustment device. The second end of the adjusting lever is operatively connected to the engagement element.

5 Claims, 2 Drawing Sheets

(56) References Cited

U.S. PATENT DOCUMENTS

| | | | |
|---|---|---|---|
| 2005/0051120 | A1 | 3/2005 | Naumann |
| 2006/0021590 | A1 | 2/2006 | Bosl-Flierl et al. |
| 2006/0042577 | A1 | 3/2006 | Hara |
| 2007/0022989 | A1 | 2/2007 | Meyer et al. |
| 2012/0240889 | A1 | 9/2012 | Fessler |

FOREIGN PATENT DOCUMENTS

| | | | |
|---|---|---|---|
| JP | 2006-255586 | A | 9/2006 |
| JP | 2007-224817 | A | 9/2007 |
| JP | 2007-239470 | A | 9/2007 |
| JP | 2010-168953 | A | 8/2010 |
| WO | WO 2011/080076 | A1 | 7/2011 |

* cited by examiner

MECHANICALLY CONTROLLABLE VALVE DRIVE ARRANGEMENT

CROSS REFERENCE TO PRIOR APPLICATIONS

This application is a U.S. National Phase application under 35 U.S.C. §371 of International Application No. PCT/EP2012/075788, filed on Dec. 17, 2012 and which claims benefit to German Patent Application No. 10 2012 004 413.5, filed on Mar. 8, 2012. The International Application was published in German on Sep. 12, 2013 as WO 2013/131593 A1 under PCT Article 21(2).

FIELD

The present invention relates to a mechanically controllable valve drive arrangement having a plurality of gas exchange valves disposed in a row, wherein a transmission arrangement is associated with a gas exchange valve, the transmission arrangement has at least one intermediate lever arrangement and at least one pivot lever arrangement, an intermediate lever of the intermediate lever arrangement has a working cam for operatively connecting to a pivot lever of the pivot lever arrangement, the intermediate lever is operatively connected to a peripheral contour of a camshaft, and the intermediate lever arrangement has an engagement element which is operatively connected to a valve lift adjustment device.

BACKGROUND

Such valve drive arrangements have previously been described. DE 10 2006 033 559 A1 and DE 10 2007 022 266 A1, for example, describe valve drive arrangements with an adjustable valve lift of a respective gas exchange valve. For this purpose, both valve drive arrangements are provided with an intermediate lever arrangement that is operatively connected to a camshaft so as to periodically move the gas exchange valve and comprises an engagement element via which the maximum or minimum attainable lift height is adjusted. All these valve drive arrangements, however, suffer from the drawback that after manufacture and subsequent assembly and owing to manufacturing tolerances, an exactly desired valve lift cannot be adjusted or cannot be reproduced in the operating state. This may result in a less than satisfactory running performance of the engine in the case of short valve lifts, especially when an identical valve lift is required for all valves and cylinders of a multi-cylinder internal combustion engine.

SUMMARY

An aspect of the present invention is to provide a mechanically controllable valve drive device which avoids the above described drawbacks.

In an embodiment, the present invention provides a mechanically controllable valve drive arrangement which includes a plurality of gas exchange valves arranged in a row, each of the gas exchange valves having cylinders associated therewith, a camshaft comprising a peripheral contour, a bearing, an adjusting lever comprising a first end and a second end, a valve lift adjustment device comprising a control shaft configured to act on the first end of the adjusting lever, and a transmission arrangement associated with a respective gas exchange valve of the plurality of gas exchange valves. The adjusting lever is rotatably supported in the bearing. Each transmission arrangement comprises at least one intermediate lever arrangement comprising an engagement element, and an intermediate lever comprising a working cam, and at least one pivot lever arrangement comprising a pivot lever. The working cam of the intermediate lever is configured to operatively connect to the pivot lever of the at least one pivot lever arrangement. The intermediate lever is configured to operatively connect to the peripheral contour of the camshaft. The engagement element is configured to operatively connect to the valve lift adjustment device. The second end of the adjusting lever is configured to operatively connect to the engagement element of the at least one intermediate lever arrangement.

BRIEF DESCRIPTION OF THE DRAWINGS

The present invention is described in greater detail below on the basis of embodiments and of the drawings in which.

DETAILED DESCRIPTION

In an embodiment, the present invention provides a valve lift adjustment device comprising a control shaft which acts on a first end of an adjusting lever, wherein the second end is operatively connected to the engagement element of the intermediate lever arrangement. Using this so-called adjusting lever, it is much easier, even in the preassembled or finally assembled state, to adjust the valve lift height of the associated gas exchange valve.

In an embodiment, the adjusting lever can be arranged so as to be shiftable. The engagement element of the intermediate lever arrangement may, for example, be formed by a surface section on the intermediate lever, wherein, the adjusting lever comprises a first rotatably supported roller that may be operatively connected to the surface section of the intermediate lever. This arrangement achieves a surface pressure that is substantially lower than in conventional arrangements.

In an embodiment of the present invention, the intermediate lever may comprise a second rotatably supported roller operatively connected to the control shaft so as to further minimize signs of wear.

In an embodiment, the intermediate lever has a first roller on the side opposite the working contour which is operatively connected to the camshaft, and has a second roller which is guided in a slotted link, wherein the engagement element is provided between the first roller and the working contour.

In an embodiment of the present invention, an intermediate lever arrangement can be provided which, for example, comprises two intermediate levers that are connected to each other at the end opposite the working cam via a connecting shaft, wherein first rollers are provided for a force transmission from a camshaft on the intermediate levers, and a second roller is provided between the intermediate levers to be guided in a slotted link, wherein the engagement element is formed by the connecting shaft.

The present invention will be explained below under reference to the drawings.

Figure 1:
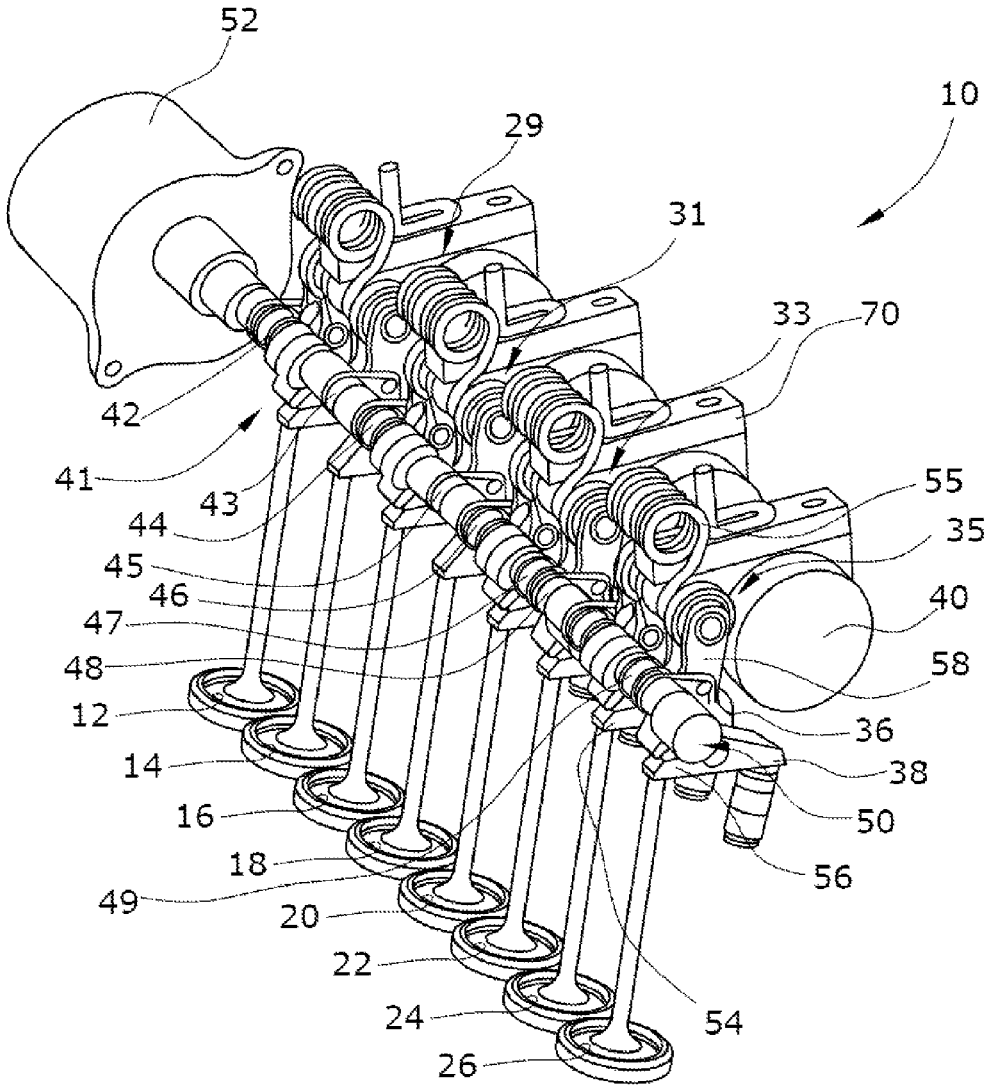
FIG. 1 shows a perspective illustration of a valve drive arrangement of the present invention operating according to the basic "univalve" principle.

FIG. 1 illustrates an embodiment of a valve drive device 10 according to the present invention comprising a plurality of gas exchange valves 12, 14, 16, 18, 20, 22, 24 and 26 arranged in a row. In the present case, two inlet gas exchange valves are associated with a cylinder of the internal combustion engine, respectively. The mechanically controllable valve drive arrangement 10, in the present case, comprises for transmission arrangements 28, 29, 30, 31, 32, 33 and 34, 35, each having two respective gas exchange valves 12, 14; 16, 18; 20, 22; 24, 26 associated therewith. The transmission arrangements 28, 29, 30, 31, 32, 33 and 34, 35 are supported in a manner known per se in the cylinder head by means of bearing means. In the present FIG. 1, the bearing means 36, 38 are illustrated merely as an example for the support of a pivot lever arrangement 56 of the transmission arrangement 35. The transmission arrangements 28, 29, 30, 31, 32, 33 and 34, 35 are further operatively connected in a manner known per se to a camshaft 40. Each transmission arrangement 28, 29, 30, 31, 32, 33 and 34, 35 can moreover be controlled via adjusting elements 42, 43, 44, 45, 46, 47 and 48, 49 of a valve lift adjustment device such that a smaller or a larger valve lift of the gas exchange valves 12, 14, 16, 18, 20, 22, 24, 26 can be adjusted. In the present embodiment, the adjusting elements 42, 43, 44, 45, 46, 47 and 48, 49 are associated with two inlet valves 12, 14; 16, 18; 20, 22; 24, 26, respectively, and are designed as control elements provided on a control shaft 50 and acting on engagement elements 75. The control shaft 50 is here designed as an eccentric shaft. It should be clear that the control shaft 50 may have any kind of control contour. In the present embodiment, the valve lift adjustment device 41 can be driven by a drive element 52 in a manner known per se. It is also possible, however, to associate one transmission arrangement with a plurality of gas exchange valves. The drive element 52 may be a rotary drive running either forward or in the reverse direction. The valve lift adjustment device 41 can thus be driven such that, depending on the present position, the valve lift corresponding to the next operational state can be chosen quickly and precisely by means of the corresponding control elements. Even rotation angles >360° can be realized thereby.

In the present embodiment, a mechanically controllable valve drive 54 includes the transmission arrangement 35 and the gas exchange valve 26. The transmission arrangement 35 is formed, in this case, by a pivot lever arrangement 56 and an intermediate lever arrangement 58, wherein the intermediate lever arrangement 58 is operatively connected to the pivot lever arrangement 56 via a working cam, and wherein the pivot lever arrangement 56 engages the gas exchange valve 26 by an end face, and the intermediate lever arrangement 58 is operatively connected with the valve lift adjustment device 41 and the camshaft 40. The adjusting element 48 of the valve lift adjustment device 41 engages an engagement element (e.g. a roller, see FIG. 2) of the intermediate lever arrangement 58 against a biasing force of a spring 55, said element not being illustrated in detail. The intermediate lever arrangement 58 engages the pivot lever arrangement 56 via a working cam 60 (not illustrated in detail in FIG. 1).

Figure 2:
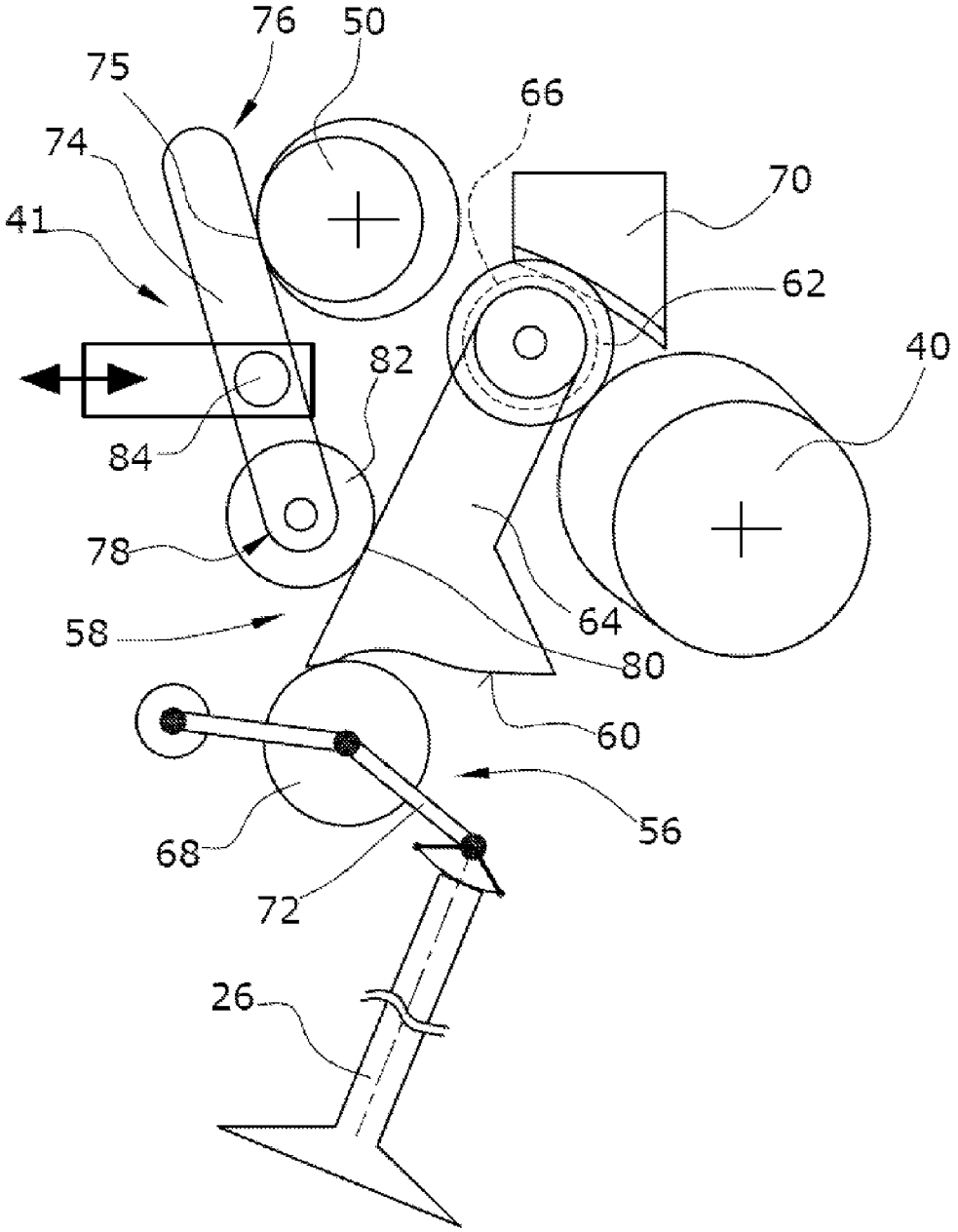
FIG. 2 shows a schematic side elevational view of an embodiment of a valve drive arrangement for a gas exchange valve according to the present invention.

FIG. 2 shows a schematic side elevational view of an inventive embodiment of a valve drive arrangement 10 for the gas exchange valve 26. Clearly discernible is the camshaft 40 which is operatively connected to a first roller 62 that is rotatably supported at an end opposite the working cam 60 of an intermediate lever 64 of the intermediate lever arrangement 58. The lifting movement of the gas exchange valve 26 is triggered by the camshaft 40 against the intermediate lever 64 which is under the bias of a spring (not illustrated). The intermediate lever 64 is further supported in a slotted link 70 via a second roller 66. As illustrated in FIG. 1, in the present embodiment, the slotted link 70 is operatively connected to two transmission arrangements. It is also possible to provide a single slotted link 70 for each transmission arrangement. The second roller 66 is illustrated in FIG. 2 in dotted lines only since it is covered by the first roller 62. The working cam 60 of the intermediate lever 64 is operatively connected, in a manner known per se, to a roller 68 of the pivot lever 72 for the gas exchange valve 26. Different from prior art in which an adjusting element directly engages an engagement element of the intermediate lever, an adjusting lever 74 is provided which is rotatably supported in a bearing 84, the control shaft 50 acting on the first end 76 of the adjusting lever 74 and the second end 78 thereof being operatively connected to an engagement element 80 of the intermediate lever arrangement 58. In the present embodiment, the engagement element 80 of the intermediate lever arrangement 58 is formed by a surface section 80 of the intermediate lever 64. The adjusting lever 74 has a first rotatably supported roller 82 that is operatively connected to this surface section 80. Such a design causes a relocation of the control shaft contact roller as the engagement element out of the intermediate lever 64 so that the mass and thereby also the mass moment of inertia of the intermediate lever 64 are reduced. This results in a greater engine speed stability of the system. In the valve drive arrangement of the prior art, high surface pressures further occur between the control shaft and the engagement element. In the solution illustrated herein, this contact is replaced with two contacts, i.e., with the contact between the control shaft 50 and the adjusting lever 74 and, further, with the contact between the first roller 82 of the adjusting lever 74 and the surface section 80 of the intermediate lever 64. Significantly lower surface pressures are thus obtained.

In the present case, the adjusting lever 74 is also supported for displacement in a bearing 84, as is schematically indicated by a double-headed arrow. Due to the adjusting lever 74 being supported in a displaceable manner, a fine adjustment of the valve lifts is easy to realize.

It is also possible to provide an embodiment where an intermediate lever arrangement comprises two intermediate levers connected in a manner known per se at the end opposite working cam via a connecting shaft. First rollers are here provided for the transmission of force from a camshaft onto the intermediate levers, and a second roller is arranged between the intermediate levers and is provided to be guided in the slotted link. The engagement element for the adjusting lever is in this case formed by the connecting shaft.

The present invention is not limited to embodiments described herein; reference should be had to the appended claims.

What is claimed is:

1. A mechanically controllable valve drive arrangement comprising:

a plurality of gas exchange valves arranged in a row, each of the gas exchange valves having cylinders associated therewith;

a camshaft comprising a peripheral contour;

a bearing;

an adjusting lever comprising a first end and a second end, the adjusting lever being rotatably supported in the bearing;

a valve lift adjustment device comprising a control shaft configured to act on the first end of the adjusting lever;

a transmission arrangement associated with a respective gas exchange valve of the plurality of gas exchange valves, each transmission arrangement comprising, at least one intermediate lever arrangement comprising an engagement element, and an intermediate lever comprising a working cam, and at least one pivot lever arrangement comprising a pivot lever, the working cam of the intermediate lever being configured to operatively connect to the pivot lever of the at least one pivot lever arrangement, the intermediate lever being configured to operatively connect to the peripheral contour of the camshaft, and the engagement element being configured to operatively connect to the valve lift adjustment device, wherein, the second end of the adjusting lever is configured to operatively connect to the engagement element of the at least one intermediate lever arrangement, and the intermediate lever further comprises a first roller arranged on a side opposite the working contour, the first roller being configured to operatively connect to the camshaft, and a second roller guided in a slotted link, the engagement element being arranged between the first roller and the working contour.

2. The mechanically controllable valve arrangement as recited in claim 1, wherein the adjusting lever is arranged so as to be displaceable.

3. The mechanically controllable valve arrangement as recited in claim 1, wherein the intermediate lever of the at least one intermediate lever arrangement comprises a surface section, the engagement element of the at least one intermediate lever arrangement being formed by the surface section of the intermediate lever.

4. The mechanically controllable valve arrangement as recited in claim 3, wherein the adjusting lever further comprises a first rotatably supported roller configured to operatively connect to the surface section of the intermediate lever.

5. The mechanically controllable valve arrangement as recited in claim 1, wherein the intermediate lever further comprises a second rotatably supported roller configured to operatively connect to the control shaft.

* * * * *